United States Patent [19]

Kurrle et al.

[11] 4,163,416

[45] Aug. 7, 1979

[54] SLOTTED OUTLET FOR THE VENTILATION OF INTERIOR SPACES

[75] Inventors: Hermann Kurrle; Gottfried Müller, both of Kolbingen, Fed. Rep. of Germany

[73] Assignee: Schako Metallwarenfabrik Ferdinand Schad GmbH, Kolbingen, Fed. Rep. of Germany

[21] Appl. No.: 828,867

[22] Filed: Aug. 29, 1977

[51] Int. Cl.[2] ..... F24F 13/06; F24F 13/08

[52] U.S. Cl. ..... 98/40 R; 98/40 D; 98/121 A

[58] Field of Search ..... 98/40 R, 40 D, 40 DL, 98/121 R, 121 A; 55/481

[56] References Cited

U.S. PATENT DOCUMENTS

| | | | |
|---|---|---|---|
| 2,206,749 | 7/1940 | Morgan | 98/40 D |
| 2,800,851 | 7/1957 | Kronrad et al. | 98/40 R |
| 3,194,145 | 7/1965 | Robertson, Jr. | 98/40 C |
| 3,242,847 | 3/1966 | Averill et al. | 98/40 D |
| 3,308,744 | 3/1967 | Schach | 98/40 D |
| 3,308,745 | 3/1967 | Davies | 98/40 D |
| 3,570,385 | 3/1971 | Heisterkamp et al. | 98/40 R |
| 3,808,777 | 5/1974 | Neumann et al. | 98/40 D |

FOREIGN PATENT DOCUMENTS

| | | | |
|---|---|---|---|
| 2333372 | 1/1975 | Fed. Rep. of Germany | 98/40 D |
| 2308873 | 11/1976 | France | 98/40 D |
| 449344 | 6/1936 | United Kingdom | 98/40 R |

*Primary Examiner*—James Kee Chi

*Attorney, Agent, or Firm*—Blair, Brown & Kreten

[57] ABSTRACT

The invention relates to a slotted outlet for the delivery of air into an interior space, with a plate which can be inserted into the wall of the interior space (inside room) in order to close an air intake passage and which contains at least one outlet slot and at least one air guidance lamina which is arranged on the inside of the plate.

12 Claims, 8 Drawing Figures

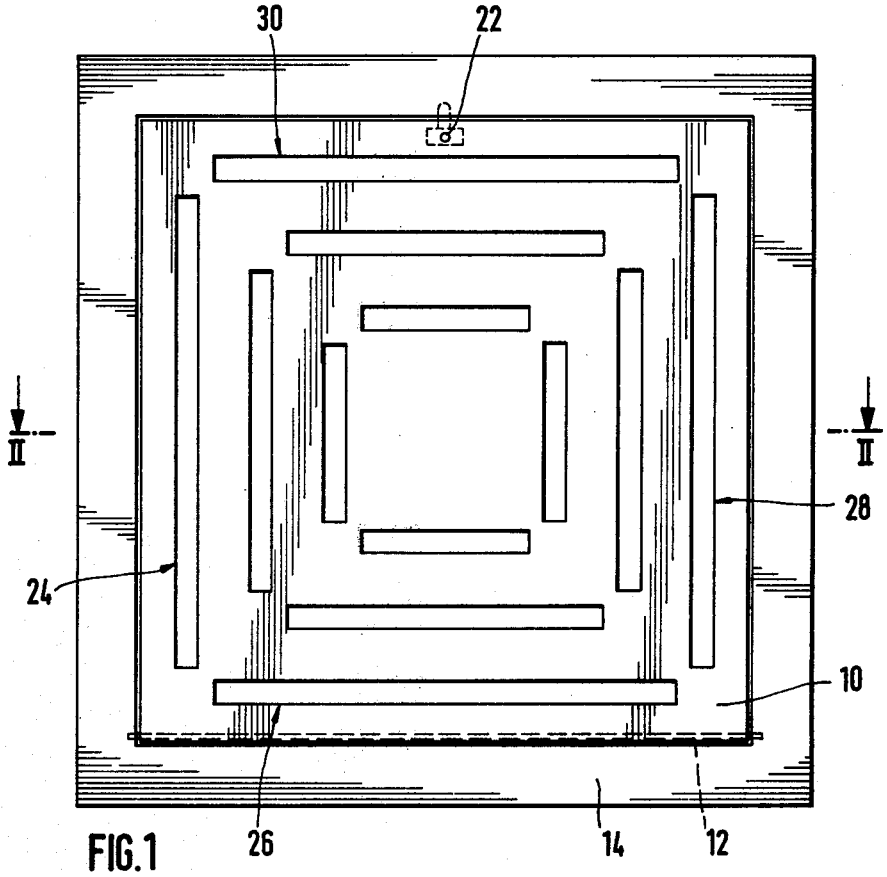
FIG. 1
FIG. 2
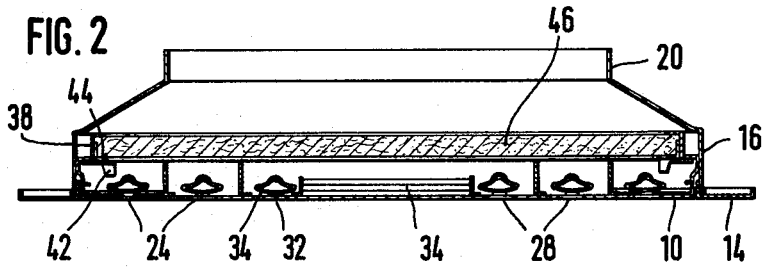

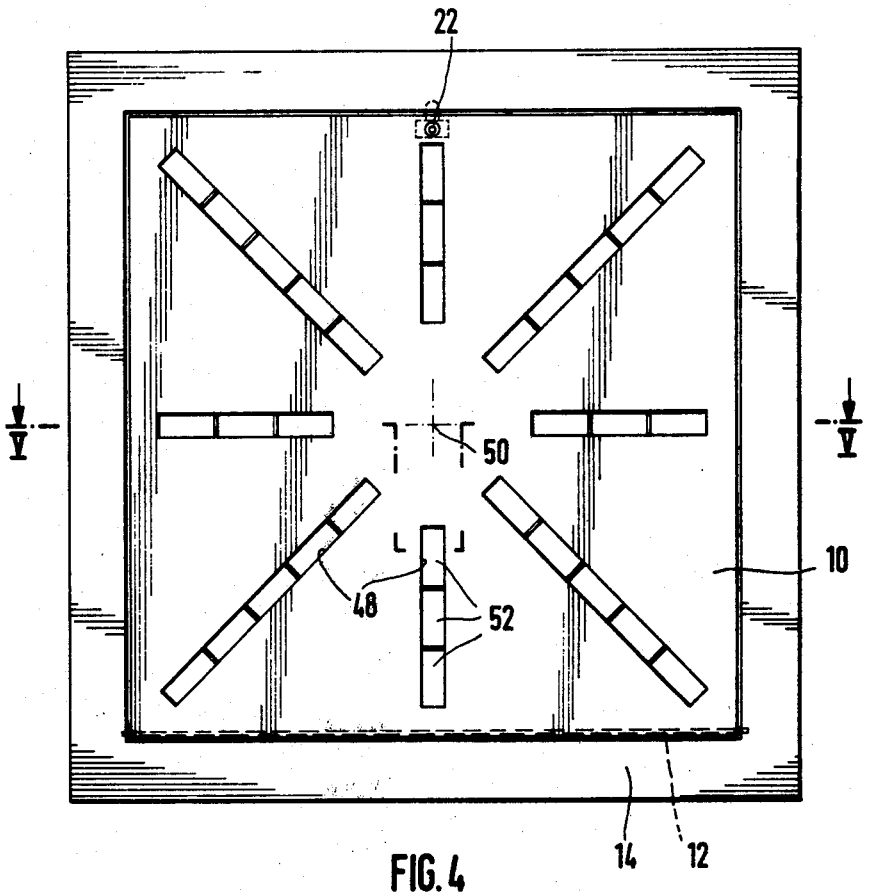
FIG. 4
FIG. 5
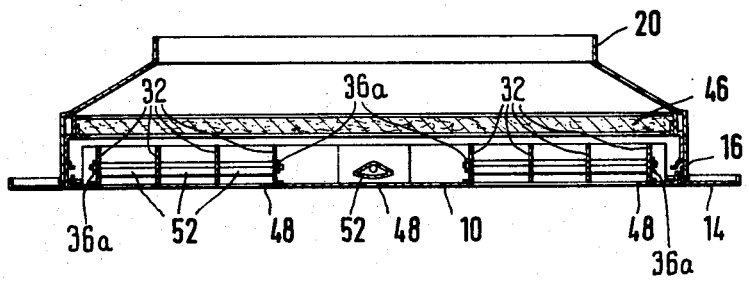

SLOTTED OUTLET FOR THE VENTILATION OF INTERIOR SPACES

BACKGROUND OF THE INVENTION

FIELD OF THE INVENTION

A large number of different types of air outlets are used for the ventilation of interior spaces. Long slotted outlets are known for the uniform ventilating of certain parts of a space. Grilles or circular apertures which are closed by movable laminae are known for supplying larger quantities of air. In order to prevent air equalization between interior and exterior spaces, so-called door screen grilles are known, which are usually incorporated in the ceiling or floor close to an opening in the room, such as a door or the like. If these grilles are incorporated in floors, they must be protected from being trodden on and neverthe less possess an adequate air throughout cross-section. Furthermore, grilles which have to possess a certain strength and also sufficient air throughput cross-section, are in use in gymnasia or the like. Furthermore, it is customary to use so-called filter grilles in which the grilles are provided with dust filters or other filters. According to the purpose for which they are to be used and their manner of incorporation into a building, all these types of air outlets have to be kept in stock in various sizes and various shapes by firms specialising in air and climate technology on an extensive scale. Each individual grille has to be specially designed for the respective purpose for which it is to be used according to various technical data. A large number of air outlets have to be manufactured in various designs with relatively small numbers of parts for each individual ventilation installation. Moreover, comparatively little air can be delivered to an interior space with all known ventilation grilles and slotted outlets. This means, however, that a great many connections for air outlets have to be provided when a ventilation installation is designed. This involves considerable costs on material and assembly in manufacture and installation. Furthermore, control of such an installation with many air outlets is exceptionally difficult and requires very great expenditure of time.

Furthermore, in the case of known air outlets, it is not easy to ventilate each part of a certain interior space with air uniformly or in the desired proportion. For example, the air which is admitted to certain parts of an interior space is felt as a disturbing draught, whilst in other parts a more intensive ventilation may be necessary.

A special problem can be seen in the fact that whilst in general the intake of larger quantities of air is desirable or necessary, these quantities of air have to mix with the air already in the space as soon as possible and as uniformly as possible, and also more especially, with as little as possible noise development. Certainly, the radius of action of the emerging air currents must not be too strongly curtailed under the influence of this mixing, as otherwise certain areas of space would not be supplied with fresh air at all.

The present invention concerns an outlet of the slotted type which considerably simplifies the construction of ventilation installations, operates without much noise, has a relatively large throughput of air, and nevertheless very good induction, i.e. mixing of the air currents with the room air to a simple possibility of directing the air currents. The disadvantages of known air outlets which have been described are removed by the slotted outlet according to the invention.

This problem is solved by the invention, in that at least one air guidance lamina which is arranged parallel to the longitudinal axis of the outlet slot and is pivotable about its longitudinal axis and/or is movable vertically to its longitudinal axis is arranged at a spacing from the inside of each outlet slot, the width of which (lamina) exceeds the width of the appropriate outlet slot.

The slotted outlet of the invention can be manufactured exceptionally easily, for its essential component can be a preferably flat sheet metal plate in which the outlet slots are punched. Basically, outlet slots of any length can be provided, depending upon the desired throughput quantity and the desired directions of emergence of the air currents. In this connection, it is essential that the air guidance laminae which are coordinated with the outlet slots make the setting of any desired directions of emergence of the air currents from the outlet slots possible. In the case of parallel arrangement of two adjacent outlets slots, particularly, an outstanding induction effect and surprisingly little noise development result. The slotted outlets of the invention can nevertheless be operated with a large throughput of air. In a central position of the lamina in relation to the outlet slot, the latter is accessible to the air which arrives from the air intake passage, and this therefore emerges in a diffuse manner.

The spacing of each air guidance lamina from the appropriate outlet slot is selected in such a way that it comes into abutment against the plate close to one longitudinal edge of the outlet slot, when it is pivoted about its longitudinal axis. If the lamina is pivoted into a position in which one of its edges butts against the inside of the plate, a wedge-shaped space is formed between that surface of the lamina which faces the slot and that area of the plate which adjoins the latter. The air is guided in lateral direction by this wedge-shaped space and emerges at an acute angle to the outlet slot. Thereby, the air currents of various outlets can, as desired, be led parallel or more or less against each other to produce a particularly advantageous inducation effect, or they can be intentionally guided in different directions of the room (space) in order to produce a particularly uniform ventilation of the entire interior space.

If a single air guidance lamina is co-ordinated with each outlet slot, this is preferably pivotable between two end positions, in which in each case it comes into abutment against the plate close to one of the longitudinal edges of the outlet slot.

In addition to the pivoting of the guidance laminae about their longitudinal axis, or even instead of this pivotability, the air guidance laminae can be movable in transverse direction in relation to the outlet slots. By this means, the guidance and mixing effects which are aimed at can be produced with different air currents.

The slotted outlet according to the invention need be kept in stock only in very few specific embodiments, as essentially merely flat sheet metal plates are used, which are provided by means of punching tools with the outlet slots which are necessary in each case and are suited to the purpose for which they are to be used. In this case, an air guidance lamina merely has to be pivotably and/or otherwise movably fixed behind each outlet slot. The incorporation of these air guidance laminae in the ventilation grille itself or in the walls of the connecting air intake passage or air intake chest is relatively easy and requires no great expediture on labour. As, moreover, comparatively high air pressure is necessary for the large throughputs which are possible in the case of the slotted outlet of the invention, the incorporation of so-called rectifiers or similar arrangements is also unnecessary. The individual currents in this connection have a very high velocity, so that an excellent flushing-through of even larger interior spaces can be achieved. Through the areas of the plate which remain between the individual outlet slots there exist zones of low pressure which form the basis of an unexpectedly high induction effect from the emerging air currents. As a result of this there is an excellent minimum of noise in spite of relatively high emergence velocity of the air. This induction effect and noise minimum continue to be obtained even if the individual air currents do not emerge in the same direction, but flush different areas of the space.

The plate-shaped construction of the slotted outlet makes possible a simple and aesthetically satisfactory flush incorporation of the same in walls of the interior space. As a result of the flat construction, punching of the outlet slots is particularly easy.

As a result of the strength of the slotted outlet of the invention, the latter can also be immediately incorporated as a so-called door screen grill or as a ventilation grille in walls of gymnasia and the like. It should be noted, in particular, that as a result of the high induction effect, practically draught-free intake of air can be achieved in spite of high air velocities.

As a result of the high emergence velocities of the air and the minimum of noise which is nevertheless maintained, the slotted outlet of the invention can even be used as a wide-projecting grille. Its use as a door screen grille is similar. If the slotted outlet according to the invention is, for example, incorporated in the vicinity of a wall or pillar, the side which points towards the wall or pillar can, without further difficulty, be completely screened by adjusting the air guidance laminae, so that the air emerges only towards other directions of the space. Losses and draught effects are likewise avoided thereby.

The slotted outlet of the invention can be adapted very easily to any architectural design of the interior space, as it can be designed to have any sort of outline and be of any colour. It does not therefore act as a foreign body as is usually the case with normal air outlets.

Preferably, that surface of each air guidance lamina which faces the appropriate outlet slot is arched in convex manner transversely to the longitudinal extension of the same (lamina), whereby even better flow conditions result.

In further advantageous specific embodiments, the cross-section of the air guidance laminae can be U shaped or rhomboid in design, which produces special desirable types of flow in each case. In a further advantageous specific embodiment, two parallel air guidance laminae which are pivotable about their longitudinal axes or are movable perpendicularly to their longitudinal axes are arranged at a spacing from the inside of each outlet slot instead of a single air guidance lamina, which (laminae) can be pivoted or moved independently of each other and thereby likewise produce various types of flow.

In order to improve further the induction values during emergence of the air from the slotted outlet, individual laminae or all the laminae are divided, in a preferred specific embodiment of the invention, into several sections in longitudinal direction which can be pivoted independently of each other. The individual sections are here advantageously pivotably mounted on a common firm axis. The outlet slot itself can also in this case be divided additionally between the individual sections of the air guidance lamina by cross-members which are arranged vertically to its longitudinal extension. In the case of this latter specific embodiment, adjacent sections of the respective air guidance lamina can be adjusted in opposite pivoting directions, whereby bundles of air currents occur in adjacent sections which emerge in sharply divergent directions. Between these individual air current bundles there exist spaces of low pressure which ensure a good swirling round and mixing of the blown-in air with the air in the space. Thereby, it is possible to blow in air with a very great difference in temperature in relation to the temperature of the space air without causing trouble to persons who are in the room (space) through the great differences in temperature. The blown-in air current bundles, in the case of this specific embodiment, do in face mix completely with the room (space) air at quite a short distance from the slotted outlet.

In one preferred specific embodiment, the plate which forms the slotted outlet contains a plurality of outlet slots which are parallel to each other at least in groups, with at least one air guidance lamina in each case. For example, the plate can be rectangular or preferably square in design, and contain four groups of outlet slots which are parallel to one side of the rectangular or square. In this arrangement each group of outlet slots has a particularly outstanding induction effect and can be guided in certain directions of the space, independently of the other groups. Fundamentally, the flat plate can, however, also be manufactured circular or in another geometrical shape. In the event of use as a door screen grille, for example, it is also possible, however, to construct the slotted outlet as a long rectangle with two parallel outlet slots. Here, there results a particularly strong wide-projection effect with little noise development.

In another specific embodiment, the plate contains a plurality of outlet slots which are radially arranged in relation to the centre of the flat plate, with at least one air guidance lamina in each case. In the case of this specific embodiment, the induction effect is not quite so good, but instead, a very uniform flushing-through of the entire interior space in all directions can be obtained.

Basically, the ventilation grille of the invention can possess any desired shape varying from a rectangle or square, such as a circular shape or polygon. The outlet slots and air guidance laminae can then be so arranged in each case that they are optimally suited to the purpose for which they are to be used.

Since slotted outlets of this type very soon become soiled, as is well known, they have to be cleaned from time to time. This is possible only with great difficulty in the case of known firmly incorporated slotted outlets. In an advantageous construction of the invention, therefore, the plate which forms the slotted outlet is connected by means of a hinge to a frame which can be inserted in the wall of the interior space. The slotted outlet can therefore be opened at the hinge and also be cleaned on its inside in a simple manner. Locking can take place with a simple sheet metal bolt or the like.

If the slotted outlet of the invention possesses large dimensions, an air distribution grille can be arranged in the air intake passage inside the air guidance laminae, notwithstanding the generally uniformly good intake by the individual outlet slots. The quantity passing through the air distribution grille can be controlled, preferably from outside. This can be done by reduction of the air flow cross-section of the air distribution grille or even by a simple throttle of any desirable type of construction.

The air which is delivered through the outlet slots can advantageously be purified before emergence, since an interchangeable air filter of any desirable type of construction can be arranged in the air intake passage. By opening the ventilation grille at the aforementioned hinge, replacement or cleaning of the air filter can also be carried out very easily. Such cleaning of air filters in air intake passages is fraught with great difficulty in the case of known ventilation installations.

Embodiments of the invention are hereinafter described, by way of example, with reference to the accompanying drawings.

BRIEF DESCRIPTION OF THE DRAWINGS

FIG. 1 is a plan view of a first specific embodiment of the invention which is designed as a square ventilation grille with a frame;

FIG. 2 is a section along the line 11—11 in FIG. 1;

FIG. 4 is a plan view of a second specific embodiment of the invention which is designed as a square ventilation grille with a frame;

FIG. 5 is a section along the line V—V in FIG. 4;

DESCRIPTION OF THE PREFERRED EMBODIMENT

Figure 3:
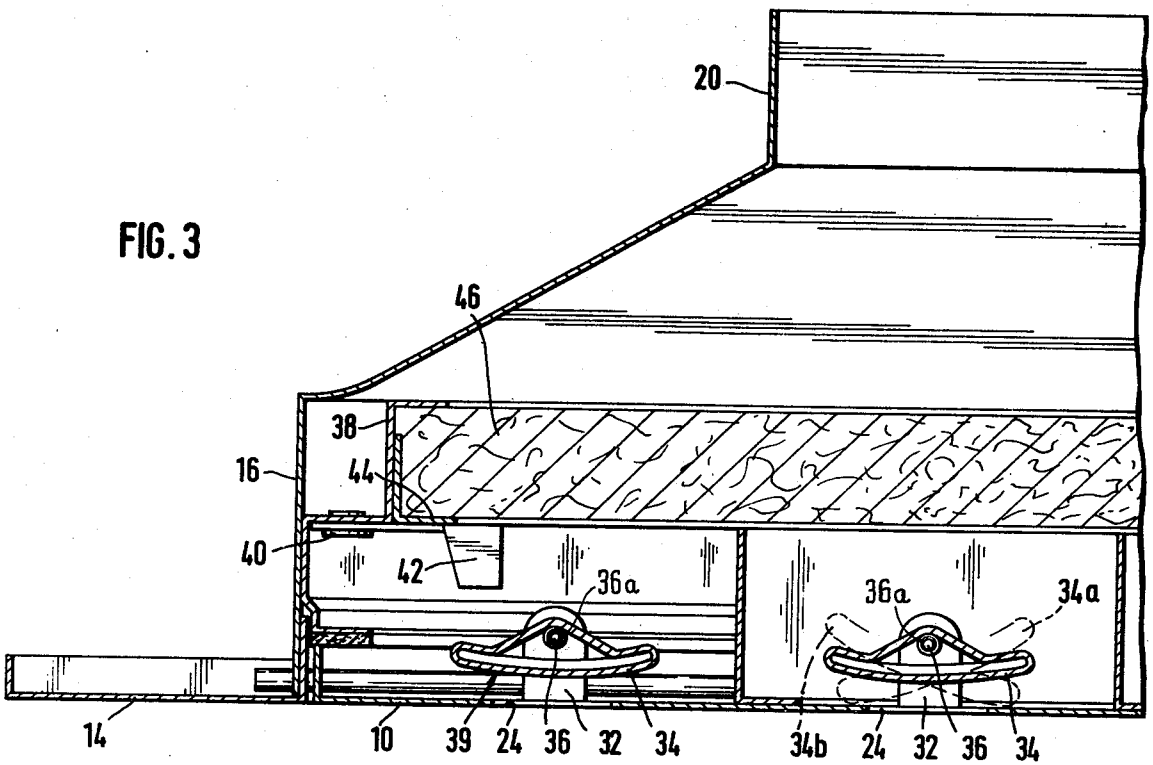
FIG. 3 is an enlargement of part of the section of FIG. 2.

The slotted air outlet shown in FIGS. 1 to 3 essentially consists of a flat square sheet metal plate 10, which is pivotally connected by means of a hing 12 running along one side of a square, to a frame 14, which is likewise square and lies in one plane with a plate 10. The frame 14 can be inserted flush into an aperture of the wall of the space which is to be ventilated, or it can rest on a surface of this wall. It can, for example, be suspended from panel supports.

An air intake chest 16, which tapers inwardly and joins a connecting socket 20 for connecting to an air intake passage, which is not shown in other respects, is connected to the frame 14 inwards in known 'per se' manner.

The flat plate 10 can be retained in the closed state on the frame 14 by means of a sheet metal bolt 22, which can be actuated from outside. The plate 10 contains four groups 24, 26, 28 and 30 of outlet slots which are in each case parallel to a respective side of the plate 10. The outlet slots are shorter in the direction towards the center of the plate 10, so that they do not overlap.

Inside each outlet slot of the groups 24 to 30 there is mounted at both ends, and in each case on stands 32, a stationary shaft 36 on which an air guidance lamina 34 is pivotable. Each lamina 34 is welded to a tube **36*a* surrounding the shaft 36 so that the lamina may be pivotally adjusted. Means, not shown, are provided to retain the laminae in their adjusted positions. Thus, the tubes 36*a* and the shafts 36 may be constructed so as to make frictional engagement with each other in order to provide the retaining forces. In the instance where a plurality of laminae 34 are mounted side-by-side on a common shaft 36, each lamina is welded to its individual short length of tube 36*a* so that the laminae may be independently rotated. In the specific embodiment which is represented, the stands 32 are fastened to the plate 10, but they can also be connected to the air intake chest 16. In a way which is not represented, the stands 32 can also be movable transversely to the longitudinal direction of the air guidance laminae 34** if desired.

The air guidance laminae 34 are wider than the outlet slots of the groups 24 to 30, and the surface 39 of each air guidance lamina which (surface) points towards the respective outlet slot is arched in convex manner. Each air guidance lamina 34 can be pivoted about the shaft 36 into the two final positions **34*a* or 34*b*, which are indicated by dashes in FIG. 6. In both final positions, one longitudinal edge of the air guidance lamina butts against the inside of the plate 10 whereby the air which flows through the outlet slot is induced to flow out at an acute angle to the plate 10. The air currents which emerge from the individual outlet slots can therefore be guided in any desired direction. In the central position of the air guidance lamina 34** which (position) is shown in continuous lines, the air leaves from both sides and a diffuse current of air is produced.

Inside the intake chest 16 there is fixed an inner frame 38, to which lugs 42, which are rotatable about vertical axis of rotation 40, are connected. The lugs 42 serve to retain a base frame 44 within the inner frame 38. The base frame, together with the inner frame 38, serve as a support for a dust filter 46, which can be removed by pivoting the lugs 42 so that the filter is convenient to clean. The filter substantially covers the entire air intake chest 16. By drawing back the bolt 22 and opening the plate 10, the inside of the ventilation grille can be cleaned very easily. By swinging the lugs 42, the base frame 44, and with it the filter 46, can be removed and likewise conveniently cleaned.

The exemplified embodiment which is represented in FIGS. 4 and 5 is basically constructed in a similar way to that just described. The same reference marks are therefore used for the same or corresponding parts. The exemplified embodiment differs from the preceeding one merely in that the outlet slots 48 run outwards radially from the center 50 of the plate 10. Moreover, the air guidance laminae are divided in the longitudinal direction into several sections 52 which are pivotable independently of each other, so that the outflow air direction can also be varied along the length of each outlet slot 48, and consequently, the induction or mixing effect of the ventilation grille can be adjusted. In other respects, the parts of this specific embodiment are designed in the same way as in the specific embodiment already described with reference to FIGS. 1 to 3, and no longer need to be described in detail.

Figure 8:
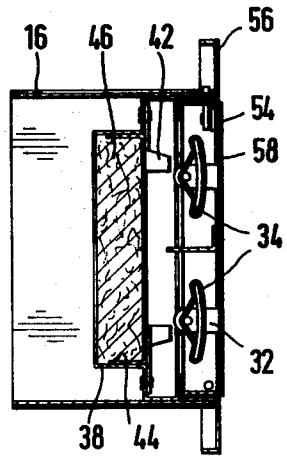
FIG. 8 is a section along the line VIII—VIII in FIG. 6.
Figure 6:
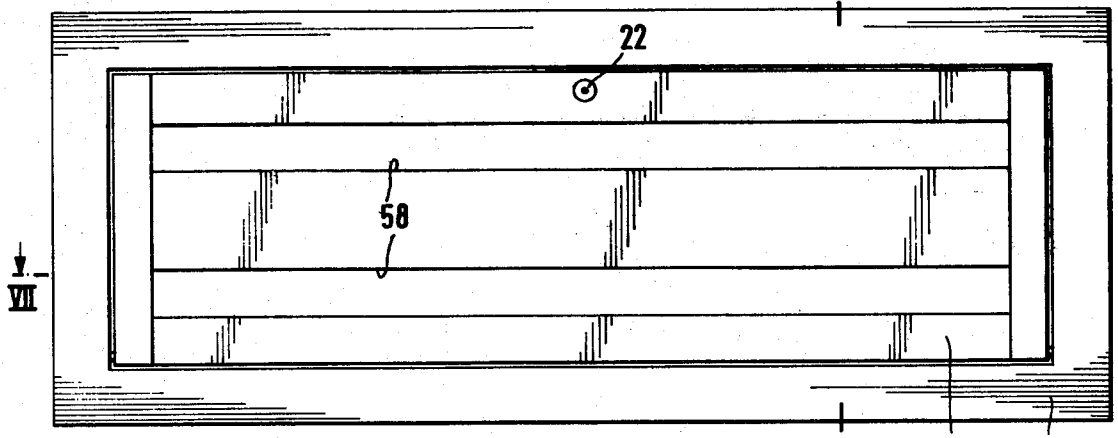
FIG. 6 is a plan view of a third specific embodiment of the invention having a long rectangular slotted outlet with a frame.
Figure 7:
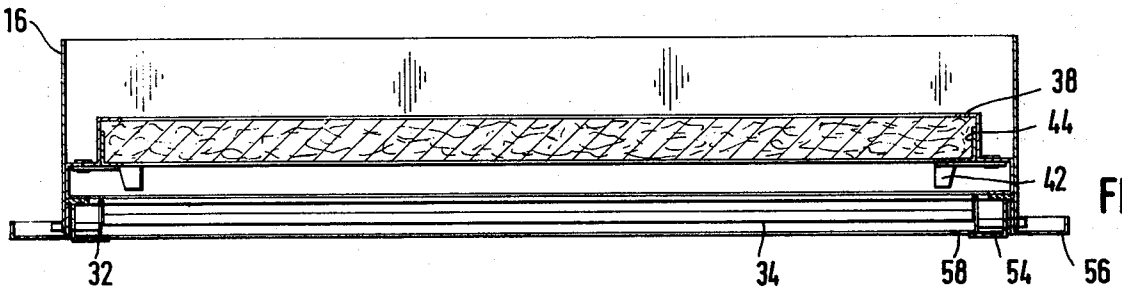
FIG. 7 is a section along the line VII—VII in FIG. 6.

The specific embodiment which is represented in FIGS. 6 to 8 can advantageously be used as a door screen grille or the like. In this specific embodiment also, parts which are constructed in the same way as in the two preceeding examples are provided with the same reference numeral. Here, the flat plate 54 and the connecting frame 56 are constructed as elongated rectangules and two outlet slots 58, which run parallel to each other in the longitudinal direction of the plate, are provided in the plate 54. Air guidance laminae 34 and brackets 32, and also the retaining devices of a dust filter 46 are constructed in the same way as in the examples described up to now. In this specific embodiment, the emerging air currents have a large radius of action with little development of noise. Here also, by pivoting the air guidance laminae 34, the air currents can be directed in different directions.

Having thus described the preferred embodiment of the invention it should be understood that numerous structural modifications and adaptations may be resorted to without departing from the spirit of the invention.

What is claimed is:

1. A slotted air outlet for the delivery of air into an interior space, adapted for connection to an air delivery passage, and mounted in a surface having an opening defined by the outlet comprising, in combination:

a face plate hinged to a frame, at least one elongated slot-type opening on said face plate, at least two stands fastened to said face plate on its side closest to the air delivery passage oriented parallel with each other and disposed at opposed extremities of said slot-type opening along the elongated extent thereof, a shaft supported on and extending between said stands, a tube surrounding said shaft, and a lamina fastened to said tube said lamina being wider than the width of said slot type opening;

whereby when said lamina is rotated, said tube rotates therewith and the lamina is held by friction between said tube and said shaft and said lamina causes air received from the air delivery passageway to be redirected through said slotted opening at angles dependent upon the orientation of said lamina and wherein said slotted opening is provided with a third stand disposed in the same sense as and between said two stands and said tube and lamina are interrupted at said third stand so each lamina portion on either side of said third stand can be independently oriented.

2. The device of claim 1 in which further stands are provided oriented similarly as said third stand and interruptions are provided on said tube and lamina at each said further stand to provide further independent orientation of each interrupted lamina.

3. An outlet according to claim 2, in which the lamina is pivotable between two end positions in which it is in abutment with the plate member at locations adjacent the longitudinal edges of the associated slotted opening.

4. An outlet according to claim 3, in which the surface of the lamina facing the associated slot in convex in a direction transverse to the elongation of the slotted opening.

5. An outlet according to claim 4, in which the lamina is tear-shaped in cross-section.

6. An outlet according to claim 4, comprising two parallel slotted openings and air guidance lamina associated with each respective slotted opening.

7. An outlet according to claim 4, comprising a plurality of groups of slots, the slots of each group being parallel to each other.

8. An outlet according to claim 7, in which the plate member is rectangular and there are four groups of slots, the slots of each group being parallel to a respective side of the plate member.

9. An outlet according to claim 8, in which the plate member is square.

10. An outlet according to claim 4, comprising a plurality of slots arranged radially with respect to the center of the plate member.

11. An outlet according to claim 4, including an air filter arranged between the lamina and the air delivery passage.

12. An outlet according to claim 11, in which the air filter is removable for cleaning.

* * * * *